US008939558B2

(12) United States Patent
Katoh et al.

(10) Patent No.: US 8,939,558 B2
(45) Date of Patent: Jan. 27, 2015

(54) IMAGE FORMING APPARATUS INCLUDING LIQUID EJECTION HEAD

(71) Applicants: Tomomi Katoh, Kanagawa (JP); Yoichi Ito, Tokyo (JP); Hiroshi Noda, Kanagawa (JP); Jun Ichinowatari, Kanagawa (JP)

(72) Inventors: Tomomi Katoh, Kanagawa (JP); Yoichi Ito, Tokyo (JP); Hiroshi Noda, Kanagawa (JP); Jun Ichinowatari, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/716,706

(22) Filed: Dec. 17, 2012

(65) Prior Publication Data

US 2013/0187985 A1 Jul. 25, 2013

(30) Foreign Application Priority Data

Jan. 23, 2012 (JP) ..... 2012-010939
Sep. 5, 2012 (JP) ..... 2012-195535

(51) Int. Cl.
*B41J 2/17* (2006.01)
*B41J 2/135* (2006.01)
*B41J 2/175* (2006.01)

(52) U.S. Cl.
CPC . *B41J 2/135* (2013.01); *B41J 2/175* (2013.01)
USPC ..... 347/84; 347/94

(58) Field of Classification Search
None
See application file for complete search history.

(56) References Cited

U.S. PATENT DOCUMENTS

| | | | | |
|---|---|---|---|---|
| 6,390,611 | B1 * | 5/2002 | Kobayashi et al. | 347/84 |
| 7,988,268 | B2 | 8/2011 | Morino | |
| 8,529,040 | B2 | 9/2013 | Yamamoto et al. | |
| 2004/0012648 | A1 | 1/2004 | Mizoguchi et al. | |
| 2004/0183876 | A1 | 9/2004 | Mizuno et al. | |
| 2005/0116997 | A1 | 6/2005 | Katoh et al. | |
| 2005/0285913 | A1 | 12/2005 | Yoshino et al. | |
| 2006/0250436 | A1 | 11/2006 | Harada et al. | |
| 2008/0049087 | A1 | 2/2008 | Morino | |
| 2009/0219323 | A1 | 9/2009 | Silverbrook et al. | |
| 2009/0290002 | A1 * | 11/2009 | Katoh | 347/85 |
| 2009/0315959 | A1 | 12/2009 | Fukazawa et al. | |
| 2010/0026755 | A1 | 2/2010 | Nishida | |
| 2010/0201759 | A1 | 8/2010 | Kawase et al. | |

(Continued)

FOREIGN PATENT DOCUMENTS

| | | |
|---|---|---|
| CN | 1519126 | 8/2004 |
| CN | 101130307 | 2/2008 |

(Continued)

OTHER PUBLICATIONS

European Search Report dated Mar. 1, 2013 in corresponding European patent application No. 12 19 6355.7.

(Continued)

*Primary Examiner* — Stephen Meier
*Assistant Examiner* — Renee I Wilson
(74) *Attorney, Agent, or Firm* — Cooper & Dunham LLP

(57) ABSTRACT

An image forming apparatus includes a liquid ejection head, a head tank, a liquid storage container, a liquid feed device, a supply valve, an exhaust passage, a float valve, an air release valve, and a suction device. The exhaust passage is disposed in the head tank and communicated with an ambient air. The float valve is disposed in the head tank to close the exhaust passage in response to an amount of liquid in the head tank. The air release valve opens and closes the exhaust passage of the head tank. When the suction device exhausts air from the exhaust passage with the air release valve open, the liquid feed device is driven to pressurize and feed the liquid.

12 Claims, 16 Drawing Sheets

(56) References Cited

U.S. PATENT DOCUMENTS

| | | | |
|---|---|---|---|
| 2010/0214378 | A1 | 8/2010 | Katoh et al. |
| 2010/0289856 | A1 | 11/2010 | Yamamoto et al. |
| 2011/0050816 | A1 | 3/2011 | Katoh et al. |
| 2011/0134184 | A1 | 6/2011 | Katoh et al. |
| 2011/0141167 | A1 | 6/2011 | Kikkawa et al. |
| 2011/0164078 | A1 | 7/2011 | Katoh et al. |
| 2011/0216111 | A1 | 9/2011 | Katoh |
| 2012/0236094 | A1 | 9/2012 | Katoh |

FOREIGN PATENT DOCUMENTS

| | | | |
|---|---|---|---|
| CN | 101861246 | | 10/2010 |
| EP | 1043161 | A2 | 10/2000 |
| JP | 4-70352 | | 3/1992 |
| JP | 5-318755 | | 12/1993 |
| JP | 2001-162825 | | 6/2001 |
| JP | 2004-142405 | | 5/2004 |
| JP | 2005-324357 | | 11/2005 |
| JP | 2007-216535 | | 8/2007 |
| JP | 2010-12657 | | 1/2010 |
| JP | 2010-23420 | | 2/2010 |
| JP | 2010-23424 | | 2/2010 |
| JP | 2010-120340 | | 6/2010 |
| JP | 2010-264616 | | 11/2010 |
| JP | 2011-251495 | | 12/2011 |
| WO | WO2009/054302 | | 4/2009 |
| WO | WO2009/066612 | | 5/2009 |

OTHER PUBLICATIONS

U.S. Appl. No. 13/206,687, filed Aug. 10, 2011, Tomomi Katoh.
Chinese official action dated Jul. 3, 2014 in corresponding Chinese patent application No. 2012 10 58 0791.0.

* cited by examiner

IMAGE FORMING APPARATUS INCLUDING LIQUID EJECTION HEAD

CROSS-REFERENCE TO RELATED APPLICATIONS

This patent application is based on and claims priority pursuant to 35 U.S.C. §119 to Japanese Patent Application Nos. 2012-010939, filed on Jan. 23, 2012, and 2012-195535, filed in Sep. 5, 2012, in the Japan Patent Office, the entire disclosure of which is hereby incorporated by reference herein.

BACKGROUND

1. Technical Field

This disclosure relates to an image forming apparatus, and more specifically to an image forming apparatus including a liquid ejection head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head) for ejecting droplets of ink.

As for the recording heads used in these liquid-ejection-type image forming apparatuses, several different types are known. One example is a piezoelectric recording head that ejects droplets by deforming a diaphragm using, e.g., piezoelectric actuators. When the piezoelectric actuators deform the diaphragm, the volumes of chambers containing the liquid change. As a result, the internal pressures of the chambers increase, thus ejecting droplets from the head. Another example is a thermal recording head that ejects droplets by increasing the internal pressures of chambers using, e.g., heaters disposed in the chambers. The heaters are heated by electric current to generate bubbles in the chambers. As a result, the internal pressures of the chambers increase, thus ejecting droplets from the head.

For such liquid-ejection type image forming apparatuses, there is demand for enhancing throughput, i.e., speed of image formation. One way to increase the throughput is to enhance the efficiency of liquid supply. For example, a tube supply method is proposed in which ink is supplied from a large-volume ink cartridge (main tank) set in an apparatus body to a head tank (sub tank or buffer tank) mounted on an upper portion of the recording head through a tube.

Such a tube supply method can reduce the weight and size of a carriage section mounting the recording head or the head tank, thus reducing the size of an entire apparatus including a structural system and a driving system.

However, to further enhance printing throughput, an increase in the number of nozzles of a recording head, an increase in the flow amount of ink feeding associated with use of higher frequency in driving a recording head, and an increase in viscosity of ink associated with shortening of drying time may be advanced. As a result, a pressure loss due to a fluid resistance of a tube against a flow of ink may cause an inks supply shortage. In particular, for an apparatus to record large-size print media, a long tube generates a large pressure loss and is more likely to cause a failure.

Conventionally, for example, JP-4032953-B (JP-2004-142405-A) proposes an apparatus having a differential pressure valve at an upstream side of an ink supply route to supply ink when a negative pressure in a sub tank is greater than a predetermined pressure value. To enhance a performance of discharging bubbles from the sub tank, the apparatus also has a mechanical assembly to forcefully open the differential pressure valve and perform choke cleaning.

JP-2007-216535-A or JP-2010-120340-A proposes to provide a float valve in a head tank. When air is exhausted from the head tank, an ink level rises. As a result, a float closes an exhaust passage to discharge only air.

However, in a configuration described in JP-4032953-B (JP-2004-142405-A), air mixed in an ink supply route can be discharged only by choke cleaning, thus resulting in an insufficient bubble discharge performance. In addition, a relatively large amount of ink is discharged with bubbles, thus causing wasteful ink consumption.

In a configuration described in JP-2007-216535-A, closing of the exhaust passage relies on a retaining force of a meniscus in an opening portion opened to an outside of the exhaust passage. As a result, if the meniscus is broken by some factors, the interior of the head tank may turn into atmospheric pressure, thus causing a failure, such as ink leakage from nozzles of a recording head.

An ink supply system described in JP-2010-120340-A, basically creates a negative pressure in the head tank by a liquid level difference, thus causing a challenge in an increase in exhausting speed. In other words, if exhausting speed is increased, a negative pressure in the head tank increases, thus sucking air from nozzles of a recording head into the head tank.

BRIEF SUMMARY

In an aspect of this disclosure, there is provided an image forming apparatus including a liquid ejection head, a head tank, a liquid storage container, a liquid feed device, a supply valve, an exhaust passage, a float valve, an air release valve, and a suction device. The liquid ejection head has nozzles to eject droplets of liquid and a nozzle face in which the nozzles are formed. The head tank supplies the liquid to the liquid ejection head. The liquid storage container stores the liquid. The liquid feed device feeds the liquid from the liquid storage container to the head tank. The supply valve is disposed in the head tank to open when a negative pressure in the head tank is greater than a predetermined value. The exhaust passage is disposed in the head tank and communicated with an ambient air. The float valve is disposed in the head tank to close the exhaust passage in response to an amount of the liquid in the head tank. The air release valve opens and closes the exhaust passage of the head tank. The suction device exhausts air from the exhaust passage. When the suction device exhausts air from the exhaust passage with the air release valve open, the liquid feed device is driven to pressurize and feed the liquid.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 28:
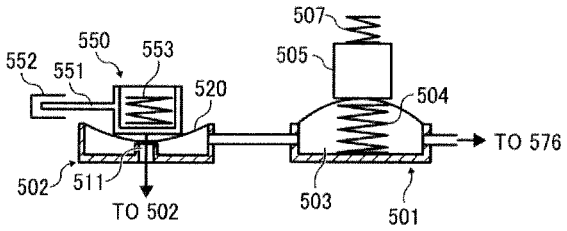
Figure 29:
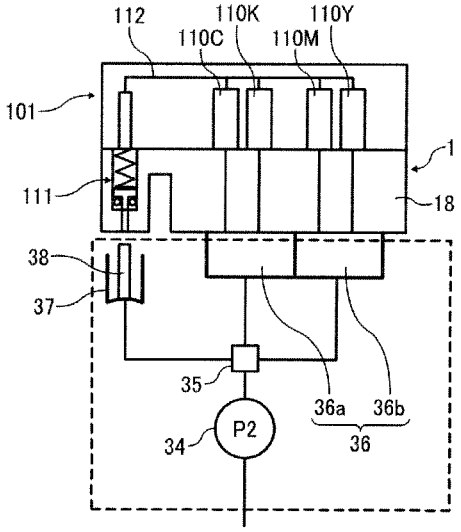
Figure 30:
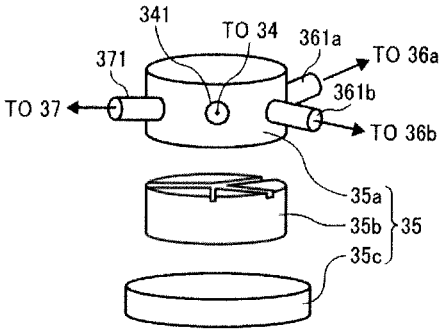
Figure 33:
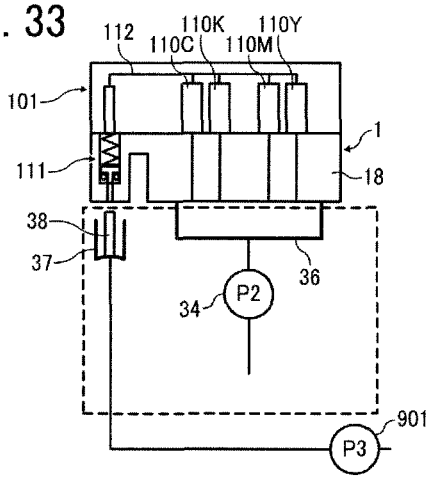
Figure 34:
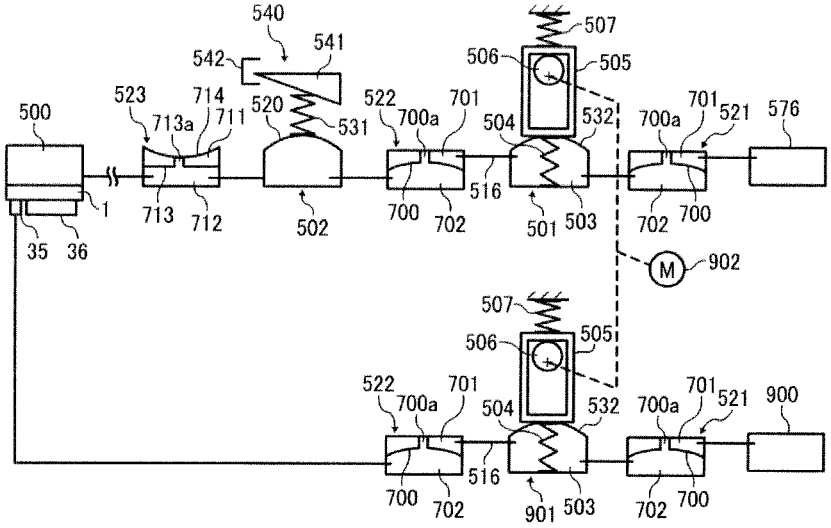
Figure 35:
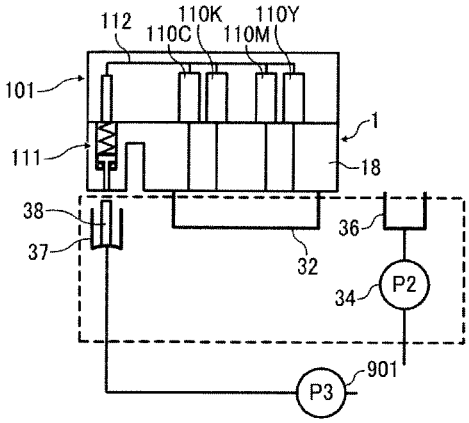

FIG, 27 is a schematic view of an ink supply system in a twelfth exemplary embodiment of this disclosure;

FIG. 28 is a schematic view of a portion of an ink supply system in a thirteenth exemplary embodiment of this disclosure;

FIG. 29 is a schematic view of a maintenance device in a fourteenth exemplary embodiment of this disclosure;

FIG. 30 is an exploded perspective view of an example of a passage switching member in the fourteenth exemplary embodiment;

FIGS. 31A to 31D are schematic views of the passage switching member during passage switching operation;

FIGS. 32A to 32D are schematic views of a passage switching member of a maintenance device in a fifteenth exemplary embodiment of this disclosure;

FIG. 33 is a schematic view of a maintenance device in a sixteenth exemplary embodiment of this disclosure;

FIG. 34 is a schematic of an ink supply system and an exhaust system he sixteenth exemplary embodiment; and FIG. 35 is a schematic view of a maintenance device in a seventeenth exemplary embodiment, The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image funning apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

Figure 1:
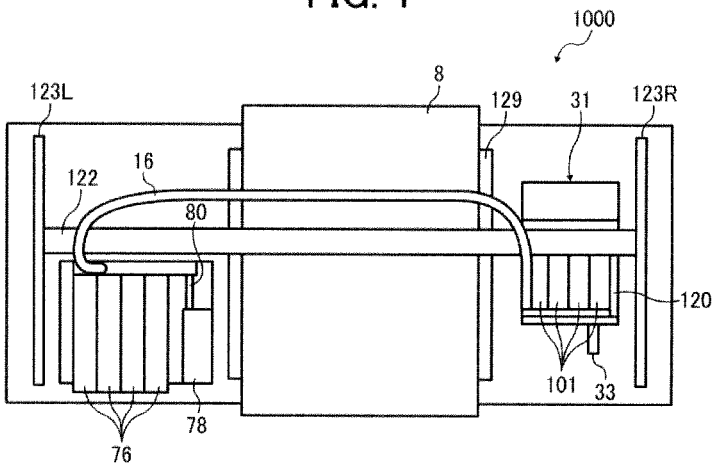
FIG. 1 is a schematic plan view of an inkjet recording apparatus as an image forming apparatus according to an exemplary embodiment of this disclosure.
Figure 2:
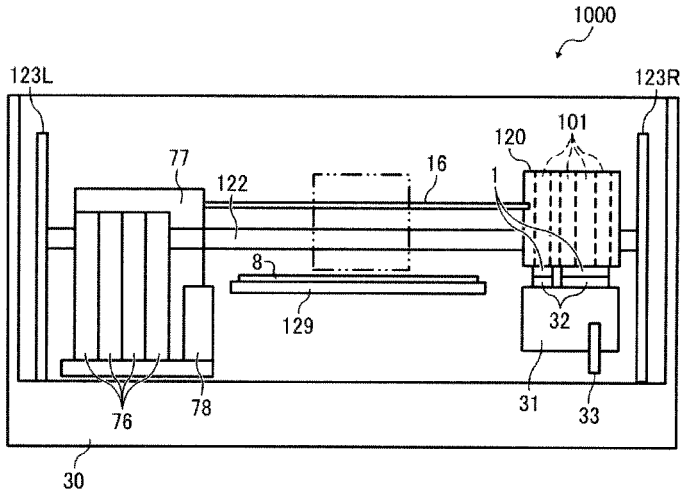
FIG. 2 is a schematic front view of the inkjet recording apparatus illustrated in FIG 1.
Figure 3:
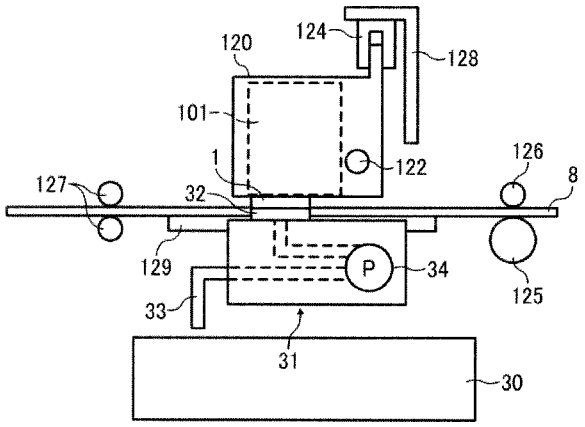
FIG. 3 is a schematic side view of the inkjet recording apparatus illustrated in FIG. 1.

First, an inkjet recording apparatus is described as an image forming apparatus according to an exemplary embodiment of this disclosure with reference to FIGS. 1 to 3.

FIG. 1 is a schematic plan view of an inkjet recording apparatus 1000 according to an exemplary embodiment of this disclosure. FIG. 2 is a schematic front view of the inkjet recording apparatus 1000. FIG. 3 is a schematic side view of the inkjet recording apparatus 1000.

In the inkjet recording apparatus 1000, a carriage 120 is supported by a guide rod 122 and a guide rail 124 so as to be movable in a main scanning direction (i.e., a longitudinal direction of the guide rod 122). The guide rod 122 serving as a guide member extends between a left side plate 123L and a right side plate 123R standing on a body frame 30, and the guide rail 124 is mounted on a rear frame 128 disposed on the body frame 30. The carriage 120 is moved in the longitudinal direction of the guide rod 122 (the main scanning direction) by a main scanning motor and a timing belt.

On the carriage 120 are mounted recording heads 1 (liquid ejection heads) for ejecting ink droplets of different colors, e.g., black (K), cyan (C), magenta (M), and yellow (Y). The recording heads I are mounted on the carriage 120 so that multiple ink ejection ports (nozzles) are arranged in rows in a direction perpendicular to the main scanning direction and ink droplets are ejected downward from the nozzles.

Figure 4:
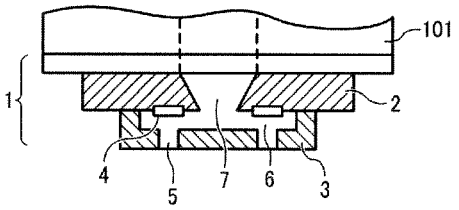
FIG. 4 is a partially enlarged view of a recording head of the inkjet recording apparatus illustrated in FIG. 1.

As illustrated in FIG. 4, the recording heads 1 include a heater substrate 2 and a chamber formation member 3 and ejects, as droplets, ink sequentially supplied to a common channel 7 and liquid chambers (individual channels) 6 through an ink supply passage formed in the heater substrate 2. As illustrated in FIG. 4, the recording heads 1 may be, for example, a thermal-type head that obtains pressure for ejecting ink by film boiling of ink generated by heaters 4 and a side-shooter-type head in which a direction in which ink flows toward each ejection-energy acting part (heater part) within each liquid chamber 6 is perpendicular to a central axis of an opening of each of nozzles 5.

It is to be noted that the recording heads 1 are not limited to the above-described thermal type head but may be a piezoelectric-type head that obtains ejection pressure by deforming a diaphragm with piezoelectric elements, an electrostatic-type head that obtains ejection pressure by deforming a diaphragm with electrostatic force, or any other suitable type head.

Below the carriage 120, a sheet 8 on which an image is formed by the recording heads I is conveyed in a direction (hereinafter "sub-scanning direction") perpendicular to the main scanning direction. As illustrated in FIG. 3, the sheet 8 is sandwiched between a conveyance roller 125 and a pressing roller 126 and conveyed to an image formation area (printing area) of the recording heads 1. The sheet 8 is further conveyed onto a print guide member 129 and fed by a pair of output rollers 127 in a sheet output direction.

At this time, scanning of the carriage 120 in the main scanning direction is properly synchronized with ejection of ink droplets from the recording heads 1 in accordance with image data to form a first band of a desired image on the sheet 8. After the first band of the image has been formed, the sheet 8 is fed by a certain distance in the sub-scanning direction and the recording heads 1 form a second band of the desired image on the sheet 8. By repeating such operations, the whole image is formed on the sheet 8.

Head tanks (also referred to as buffer tanks or sub tanks) 101 including ink chambers 104 to temporarily store ink are integrally connected to upper portions of the recording heads 1. The term "integrally" as used herein represents that the recording heads 1 are connected to the head tank 101 via, e.g., tubes or pipes and both the recording heads 1 and the head tanks 101 are mounted on the carriage 120.

Desired color inks are supplied from ink cartridges (main tanks) 76 serving as liquid tanks that separately store the respective color inks, to the head tanks 101 via ink supply tubes 16 serving as liquid supply tubes. The ink cartridges (main tanks) 76 are detachably mounted on, e.g., a cartridge holder disposed at one end of the inkjet recording apparatus 1000 in the main scanning direction.

At an opposite end of the inkjet recording apparatus 1 in the main scanning direction is disposed a maintenance and recovery device 31 (hereinafter, maintenance device 31) that maintains and recovers conditions of the recording heads 1. The maintenance device 31 has caps 32 to cover nozzle faces of the recording heads 1 and a suction pump 34 serving as a liquid suction device to suck interior of the caps 32, and a drain passage 33 to drain waste liquid (waste ink) sucked by the suction pump 34. The waste ink is discharged from the drain passage 33 to a waste liquid tank mounted on the body frame 30. The maintenance device 31 also has a moving mechanism to reciprocally move the caps 32 back and forth (in this embodiment, up and down) relative to the nozzle faces of the recording heads 1. The maintenance device 31 further has a wiping member to wipe the nozzle faces of the recording heads 1 and a wiping unit to hold the wiping member so that the wiping member is reciprocally movable back and forth relative to the nozzle faces of the recording heads 1.

Next, a head tank in a first exemplary embodiment is described with reference to FIGS. 5 to 6.

Figure 5:
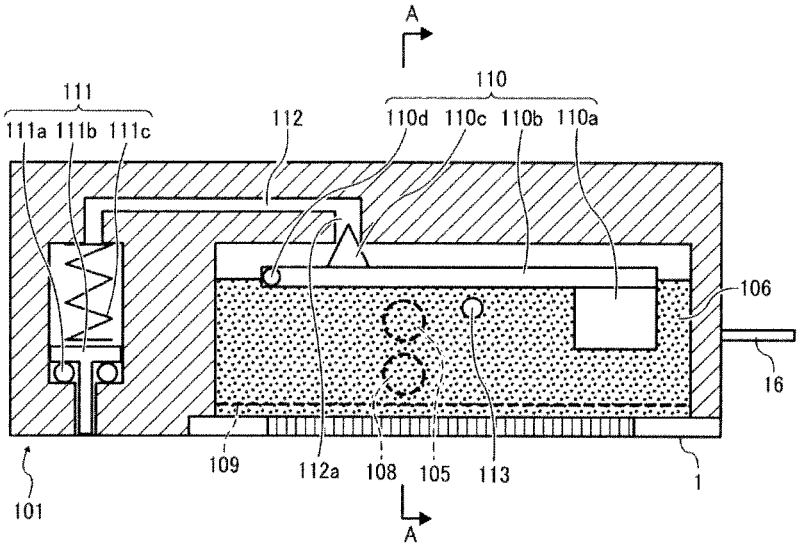
FIG. 5 is a schematic front view of a head tank in a first exemplary embodiment of this disclosure.
Figure 6A:
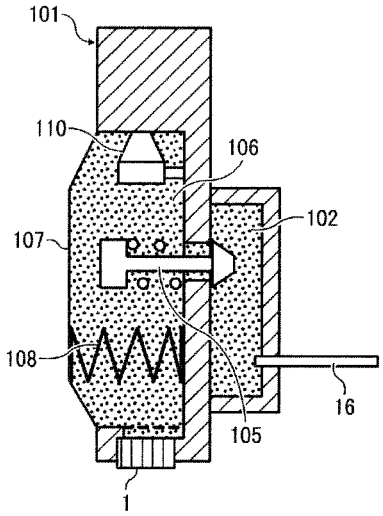
FIGS. 6A and 6B are cross sectional views of the head tank cut along a line A-A of FIG. 5.
Figure 6B:
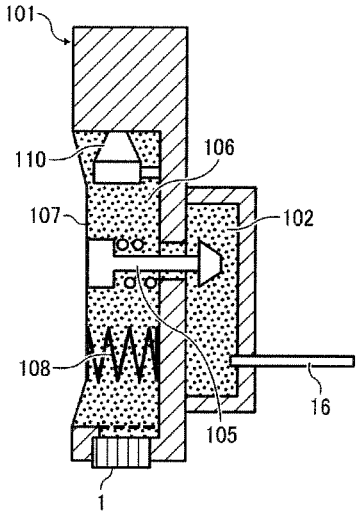

FIG. 5 is a front view of a head tank 101 in the first exemplary embodiment, and FIG. 6 is a cross-sectional view of the head tank 101 cut along a line A-A in FIG. 5. In FIGS. 5 and 6, components may be omitted or cross sections may be partially shown for clarity.

As illustrated in FIG. 6, the head tank 101 has an ink chamber 106 and an ink pressurizing chamber 102 (hereinafter, also referred to as simply "pressurizing chamber").

The head tank 101 includes a filter 109 adjacent to a connecting portion connected to a recording head 1 to filter ink to remove foreign substances from the ink, and supplies the filtered ink to the recording head 1.

The head tank 101 has a film member 107 at a wall face, and the flexible member 107 is urged by a spring 108 in a direction to increase a volume of the head tank 101. Thus, as illustrated in FIG. 6A, the film member 107 is inflated in a convex shape toward the outside of the head tank 101.

A negative-pressure conjunction valve 105 serving as a supply valve is disposed adjacent to the film member 107. The negative-pressure conjunction valve 105 is a valve to control a connection state and a non-connection state between the ink chamber 106 and the pressurizing chamber 102.

As illustrated in FIG. 6A, the negative-pressure conjunction valve 105 normally retains a closed state between the ink chamber 106 and the pressurizing chamber 102. However, when ink in the ink chamber 106 is consumed and the film member 107 displaces toward an interior of the ink chamber 106, the negative-pressure conjunction valve 105 is opened to connect the ink chamber 106 to the pressurizing chamber 102.

An exhaust passage 112 connected to an air release valve 111 is formed at an upper portion of the head tank 101. A float valve 110 is disposed at an opening portion 112*a* at an end of the exhaust passage 112 proximal to an interior of the head tank 101.

The float valve 110 includes a float 110*a*, a lever 110*b*, a sealing portion 110*c*, and a shaft 110*d*. The sealing portion

110*c* is supported by an end portion of the lever 110*b*. The sealing portion 110*c* is disposed in the ink chamber 106 so as to be able to contact the opening portion 112*a* of the exhaust passage 112. The lever 110*b* is rotatable around the shaft 110*d*. The float 110*a* is disposed at an opposite end portion of the lever 110*b*.

Here, when the ink chamber 106 includes a relatively large amount of the ink chamber 106, an ink level is low and the float valve 110 is lowered, thus connecting the ink chamber 106 to the exhaust passage 112. By contrast, when the ink chamber 106 includes a relatively small amount of the ink chamber 106, the ink level is high and the float 110*a* is raised. As a result, the sealing portion 110*c* contacts the opening portion 112*a* of the exhaust passage 112, thus closing the ink chamber 106 relative to the exhaust passage 112.

The air release valve 111 is disposed at an exit side of the exhaust passage 112 of the head tank 101. The air release valve 111 includes a sealing member 111*a*, a slider 111*b*, and a compression spring 111*c*. Normally, the sealing member 111*a* is urged by the compression spring 111*c* to shut off the exhaust passage 112 from the outside of the head tank 101.

The pressurizing chamber 102 of the head tank 101 is connected to an ink supply tube 16. In this exemplary embodiment, during printing or bubble discharging, ink in the pressurizing chamber 102 is pressurized.

Next, an ink supply system in this exemplary embodiment is described with reference to FIG. 7.

Figure 7:
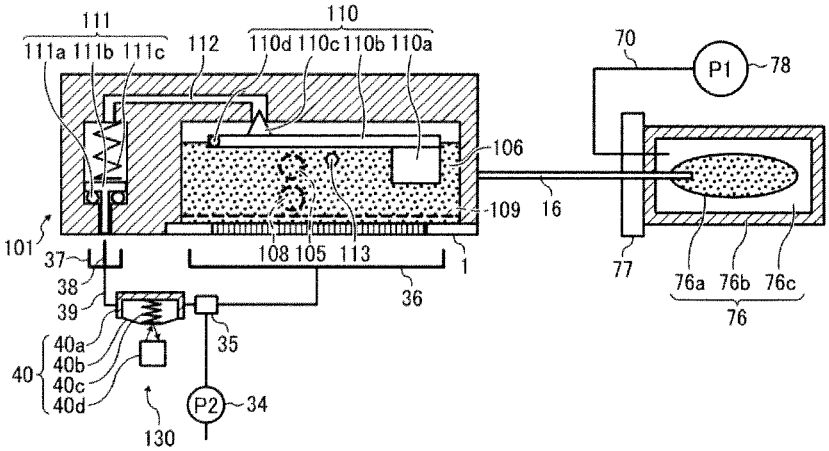
FIG. 7 is a schematic view of an ink supply system in the first exemplary embodiment.

FIG. 7 is a schematic view of the ink supply system in this exemplary embodiment. It is to be noted that the shape and arrangement of components and members are schematically illustrated for ease of understanding.

As illustrated in FIG. 7, the ink cartridge 76 serving as a liquid storage container to store ink includes an ink bag 76*a* to store ink and a case member 76*b* to accommodate the ink bag 76*a* in a closed state. An air layer 76*c* is formed in a closed space between the ink bag 76*a* and the case member 76*b*. As illustrated in FIG. 1, the ink cartridge 76 is mounted on a cartridge holder 77.

In a state in which the ink cartridge 76 is mounted on the cartridge holder 77, as illustrated in FIG. 7, the ink bag 76*a* of the ink cartridge 76 is connected to the liquid supply tube (ink supply tube) 16, and the air layer 76*c* is connected to an air supply tube 70. The air supply tube 70 is connected to a pressurizing pump 78 (P1) serving as a liquid feed device. The pressurizing pump 78 feeds air into and out from the air layer. The of the ink cartridge 76, thus allowing pressurizing of the ink bag 76*a*.

The ink bag 76*a* is connected to the pressurizing chamber 102 of the head tank 101 via the ink supply tube 16. By driving the pressurizing pump 78, the pressure of ink in the pressurizing chamber 102 is controlled.

Next, an exhaust device to emit air from the exhaust passage 112 of the head tank 101 is described below.

An exhaust device 130 opposes the air release valve 111 of the head tank 101 and has an exhaust cap 37 to close the air release valve 111. Inside the exhaust cap 37 is disposed a pin member 38 to push the slider 111*b*.

The exhaust cap 37 is connected to the suction pump 34 (P2). When the pin member 38 pushes the slider 111*b*, an interior of the exhaust cap 37 is communicated with the exhaust passage 112. When the suction pump 34 is driven, air in the ink chamber 106 is discharged by suction to the outside of the head tank 101.

In this exemplary embodiment, the suction pump 34 is a tube pump and connected to a suction cap 92 to suck nozzles of a recording head 1. A passage switching member 35 switches a suction passage between the exhaust cap 37 side and the suction cap 92 side. In other words, the exhaust device 130 also serves as a sucking device to suck ink or other liquid from the nozzles of the recording head 1.

An exhaust pressure detector 40 to detect an exhaust pressure is disposed between the emission cap 37 and the passage switching member 35.

The exhaust pressure detector 40 has a casing member 40*a*, a flexible film 40*b*, a spring 40*c*, and a sensor 40*d*. The casing member 40*a* has the film 40*b* at one face so that a volume of the casing member 40*a* is deformable. The spring 40*c* urges the film 40*b* in a direction to expand the volume of the casing member 40*a*. The sensor 40*d* is, e.g., a photosensor to detect a deformation amount of the flexible film 40*b*.

For such a configuration, during exhaust operation, when the exhaust pressure increases (negative pressure increases), an inner volume of the casing member 40*a* decreases, which can be detected with the sensor 40*d*.

Next, initial filling of ink to the recording head 1 in this exemplary embodiment is described with reference to FIGS. 8 to 11.

Figure 8:
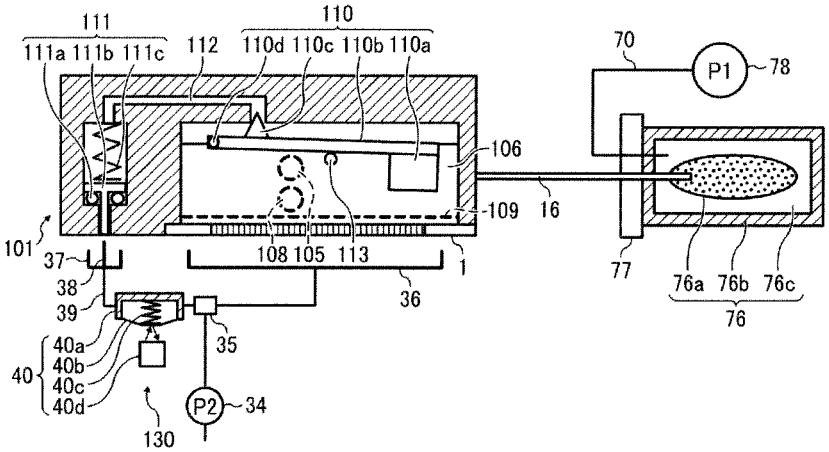
FIG. 8 is a schematic front view of the ink supply system in the first exemplary embodiment in a state before initial ink filling is performed.

FIG. 8 shows the ink supply system in this exemplary embodiment in a state before initial ink tilling. In this state, the ink chamber 106 of the head tank 101 is in atmospheric pressure, and the negative-pressure conjunction valve 105 is closed by action of the spring 108. In this state, the pressurizing pump 78 is driven to pressurize ink in the ink supply tube 16.

Figure 9:
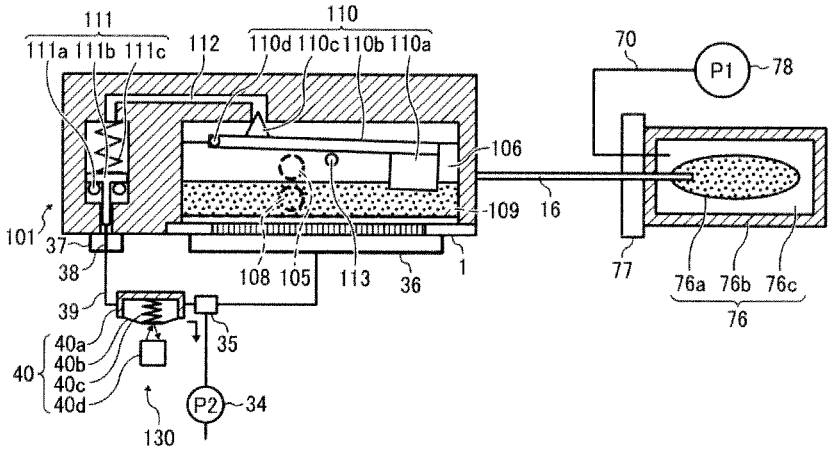
FIG. 9 is a schematic front view of the ink supply system in the first exemplary embodiment in a state during initial ink filling.

Next, as illustrated in FIG. 9, the air release valve 111 is closed by the emission cap 37, and the nozzle face of the recording head 1 is closed by a suction cap 36. In this state, the passage switching member 35 communicates the suction pump 34 with the emission cap 37, and the suction pump 34 is driven. At this time, since the air release valve 111 is opened by the pin member 38 of the emission cap 37, air is exhausted from the ink chamber 106.

Since air exhausting increases a negative pressure in the ink chamber 106, the negative-pressure conjunction valve 105 is opened, thus flowing ink from the ink cartridge 76 to the ink chamber 106 of the head tank 101.

At this time, since the pressurizing pump 78 is driven to pressurize ink in the ink supply tube 16, pressure loss due to flow of ink from the ink cartridge 76 to the pressurizing chamber 102 is canceled. As a result, air can be exhausted at a high speed, thus allowing ink to be filled to the ink chamber 106 in a short time.

Ink entering the ink chamber 106 accumulates in a space higher than the filter 109, and as illustrated in FIG. 9, the float 110*a* rises with rising of an ink level. As a result, when the sealing portion 110*c* of the float valve 110 closes the opening 112*a* of the exhaust passage 112, inflow of ink to the ink chamber 106 stops, thus sharply increasing a negative pressure in the exhaust passage 112.

Figure 10:
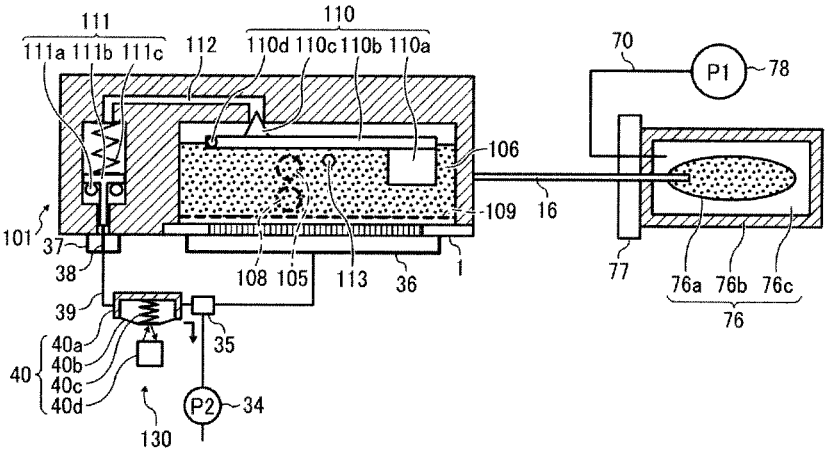
FIG. 10 is a schematic front view of the ink supply system in the first exemplary embodiment in another state during initial ink filling.

As a result, the flexible film 40*b* of the exhaust pressure detector 40 greatly deforms. When the sensor 40*d* detects the deformation, as illustrated in FIG. 10, the suction pump 34 is stopped.

Next, the emission cap 37 and the pin member 38 are detached from the air release valve 111. As a result, the ink chamber 106 is shut off from the atmosphere.

Figure 11:
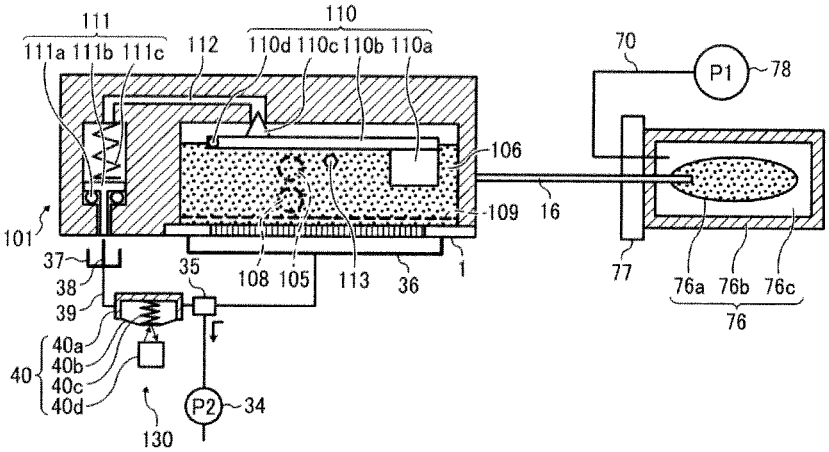
FIG. 11 is a schematic front view of the ink supply system in the first exemplary embodiment in still another state during initial ink filling.

Next, as illustrated in FIG. 11, the suction pump 34 is communicated with the suction cap 92 by the passage switching member 35 and is driven. As a result, ink is introduced into a lower portion of the filter 109 and filled into the recording head 1.

Then, a wiper wipes the nozzle face of the recording head 1 and the pressurizing pump 78 is stopped. Thus, initial ink filling is finished.

According to a method similar to the initial ink filling, the exhaust device can gradually discharge air accumulated in the ink chamber 106.

As described above, the ink supply system in this exemplary embodiment can exhaust air while pressurizing ink, thus shortening an exhausting time.

In this exemplary embodiment, the exhaust pressure detector 40 is provided to detect an increase in exhaust pressure to control stopping of the suction pump 34. However, it is to be noted that the exhaust pressure detector 40 may not be required.

For example, the suction pump 34 may be a constant pressure pump, thus obviating the exhaust pressure detector 40. In a case in which the exhaust passage 112 is not fully closed by the float valve 110, when air is fully exhausted from the ink chamber 106, ink flows from the ink chamber 106 to the exhaust passage 112. However, since a fluid resistance (resistance against a flow of ink) in the seal portion 110*c* is quite high and pressure loss increases, a negative pressure of an exhaust section increase. As a result, the suction pump 34 cannot suck air (substantially ink), and discharging of substantially ink is stopped.

For the ink supply system in this exemplary embodiment, pressurizing assistance allows high speed ink filling Simultaneously, by action of the negative-pressure conjunction valve, negative pressure is maintained within a proper range while ink is replenished in an on-demand manner. In addition, air bubbles can be discharged without discharging ink.

As a result, for example, even in a case in which the ink supply tube 16 is a long tube having a relatively large fluid resistance as in an inkjet recording apparatus capable of printing large-width recording media, the above-described configuration prevents insufficient replenishment of ink to the recording head 1, which is, in particular, suitable for a high speed printer capable of printing large-width recording media.

In other words, as a system that sucks and exhausts air via an air release valve air bubbles in a head tank integrally formed with a recording head and including a supply valve to open and close in response to a negative pressure of the head tank, the ink supply system in this exemplary embodiment has the float valve 110 to close the exhaust passage 112 in response to an amount of liquid in the head tank 101 and exhausts air from the head tank 101 while driving the liquid feed device (pressurizing pump 78). Such a configuration can supply liquid to the liquid ejection head (recording head 1) at a great flow amount while stably maintaining a negative pressure of the liquid ejection head within a proper range. Such a configuration can also discharge air from the head tank 101 in a relatively short time without wasting the liquid.

Next, a second exemplary embodiment of this disclosure is described with reference to FIGS. 12 and 13.

Figure 12:
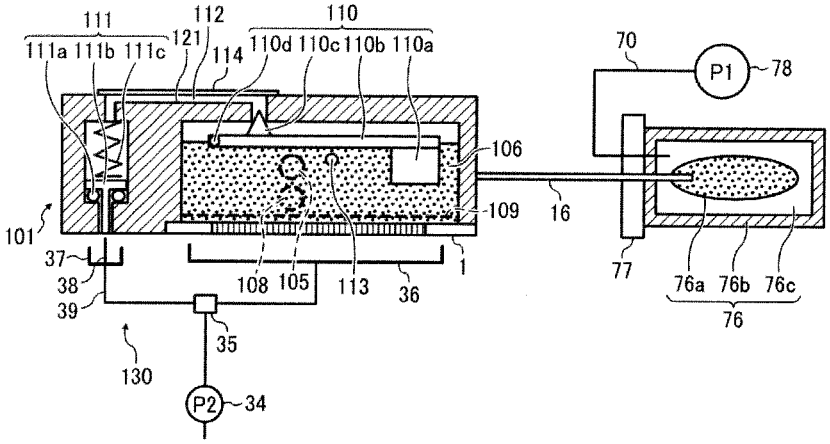
FIG. 12 is a schematic view of an ink supply system in a second exemplary embodiment of this disclosure.
Figure 13:
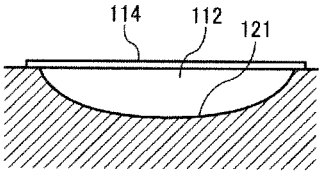
FIG. 13 is a schematic enlarged view of a portion of supply system illustrated in FIG. 12.

FIG. 12 is an ink supply system in the second exemplary embodiment. FIG. 13 is an enlarged view of a portion of the ink supply system of FIG. 12.

In this exemplary embodiment, an exhaust passage 112 of a head tank 101 has a shape in which a groove 121 formed in a wall face of the head tank 101 is covered with an elastic member 114.

For such a configuration, when air exhaust is completed and a negative pressure in the exhaust passage 112 increases, the elastic member 114 deforms to compress the exhaust passage 112. As a result, even when a float valve 110 is not fully sealed, the elastic member 114 seals the exhaust passage 112, thus preventing transmission of sucking pressure of the suction pump 34 to the ink chamber 106.

In other words, at least a portion of a wall face of the exhaust passage 112 is formed of the elastic member 114, and when the float valve 111 is closed, the elastic member 114 deforms to seal the exhaust passage 112. When sucking operation and air exhausting operation are completed. Such a configuration can automatically seal the exhaust passage 112, thus enhancing control performance of air exhaust.

As a result, the ink supply system in the second exemplary embodiment can reliably prevent outflow of ink to the exhaust passage 112 without detecting an exhaust pressure as in the first exemplary embodiment.

Here, as described above, in a case in which a portion of a wall face of the exhaust passage 112 is formed of the elastic member 114, a negative pressure causes the elastic member 114 to compress the exhaust passage 112. Hence, the groove 121 forming part of the exhaust passage 112 preferably has an arc shape, e.g., as illustrated in FIG. 13 in a cross section in a direction perpendicular to a direction in which ink or other liquid flows)

Figure 14:
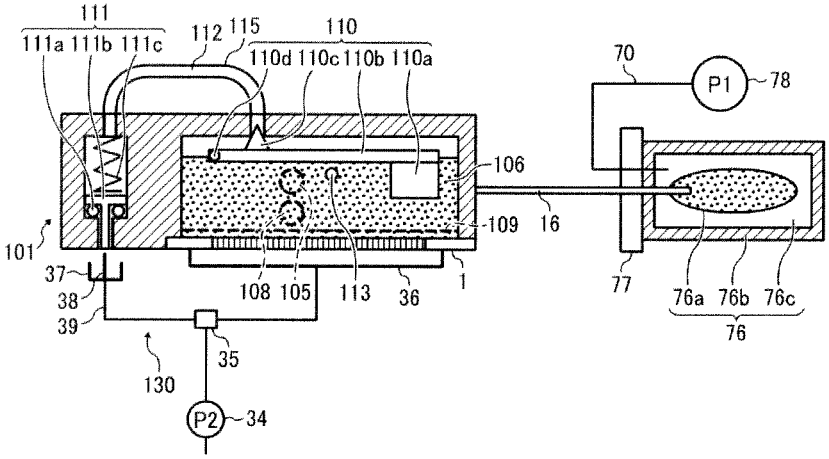
FIG. 14 is a schematic view of an ink supply system in a third exemplary embodiment of this disclosure.

Next, a third exemplary embodiment of the present disclosure is described with reference to FIG. 14, FIG. 14 is an ink supply system in the third exemplary embodiment.

In this exemplary embodiment, as illustrated in FIG. 14, at least a portion of an exhaust passage 112 is formed of an elastic tube 115.

Such a configuration can obtain effects equivalent to those of the above-described second exemplary embodiment.

Next, a fourth exemplary embodiment of the present disclosure is described with reference to FIG. 15.

Figure 15:
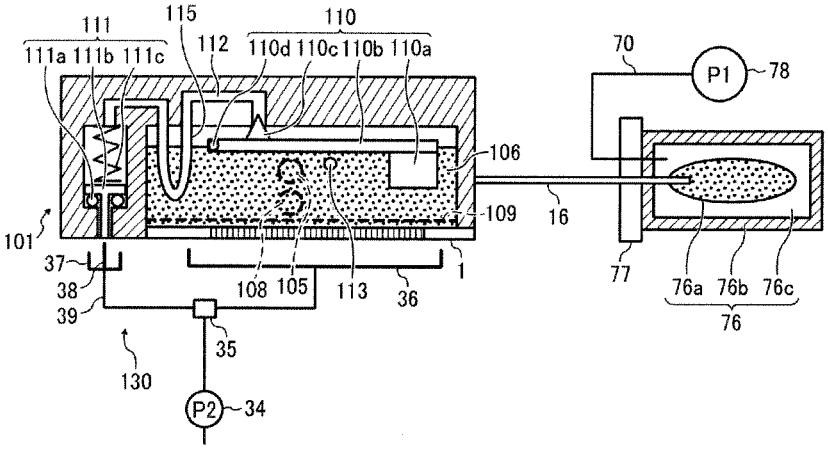
FIG. 15 is a schematic view of an ink supply system in a fourth exemplary embodiment of this disclosure.

FIG. 15 is an ink supply system in the fourth exemplary embodiment.

As described above, for the above-described second and third exemplary embodiments, at least a portion of the exhaust passage 112 is formed of the elastic member 114 or the elastic tube 115. If the elastic member 114 or the elastic tube 115 is made of a less permeable material, e.g., silicone rubber, ink introduced to the exhaust passage 112 might dry up and fix in the exhaust passage 112.

Hence, in this fourth exemplary embodiment, an outer space of an elastic member is soaked in ink. In FIG. 15, an elastic tube 115 is soaked in ink in an ink chamber 106, Such a configuration enhances reliability on drying.

For a sealing portion 110*c* of a float valve 110, when ink adhering to the sealing portion 110*c* in printing operation is left for a long period, the ink adhering to the seal portion 110*c* might dry up depending on permeability of a film member 107 forming part of a head tank 101. As a result, even when an ink level decreases, the float valve 110 might not be opened.

In such a case, the sealing portion 110*c* is made of a porous material (porous body) and partially soaked in ink.

Such a configuration can constantly maintain a surface of the sealing portion 110*c* in a humid state, prevents ink from being fixed on the sealing portion 110*c* due to drying, maintain a performance of the float valve 110 over a long non use period, and stably maintain air exhaust performance, Next, a fifth exemplary embodiment of this disclosure is described with reference to FIGS. 16 and 17.

Figure 16:
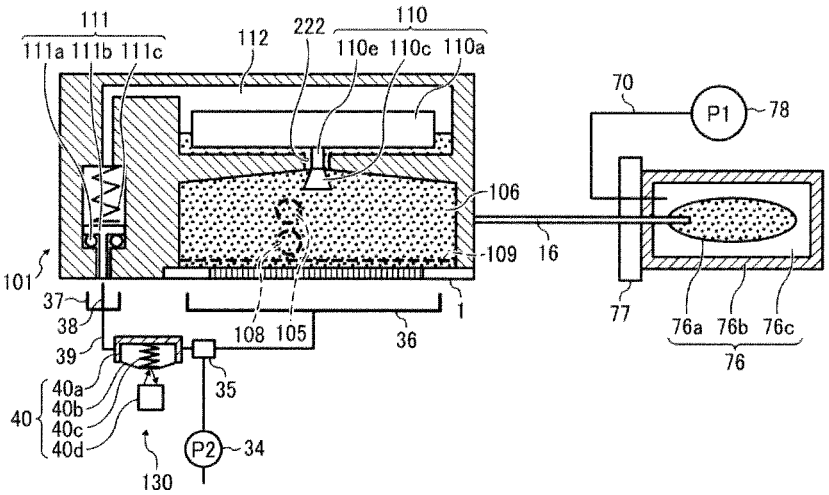
FIG. 16 is a schematic view of an ink supply system in a fifth exemplary embodiment of this disclosure.
Figure 17:
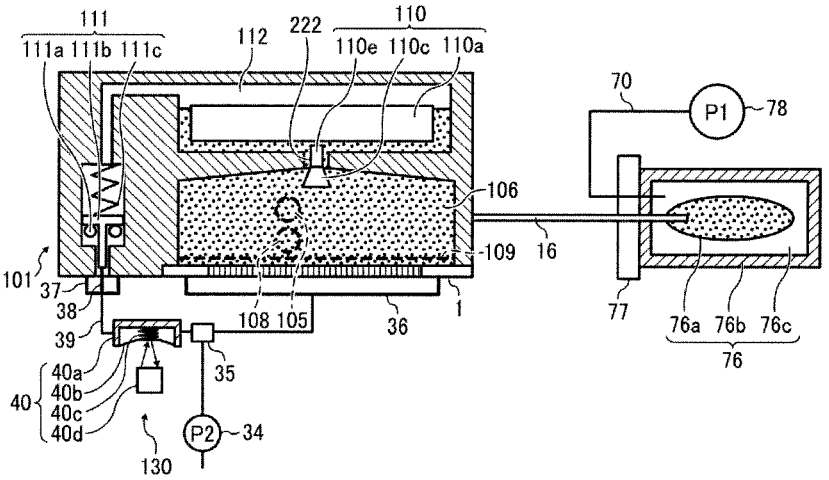
FIG. 17 is a schematic view of the ink supply system in the fifth exemplary embodiment of this disclosure in a state during air exhausting.

FIGS. 16 and 17 are schematic views of an ink supply system in the fifth exemplary embodiment.

In the fifth exemplary embodiment, an exhaust passage 112 is disposed above an ink chamber 106, has a large volume, and includes a float 110*a*. A sealing portion 110*c* is connected to a lower portion of the float 110*a* via a rod 110*e*.

In a state in which the sealing portion 110*c* is in contact with a periphery of an inlet portion 222 of the exhaust passage 112, the sealing portion 110*c* does not fully seal the inlet portion 222 and forms a minute clearance between the inlet portion 222 and the sealing portion 110*c*.

Figure 18:
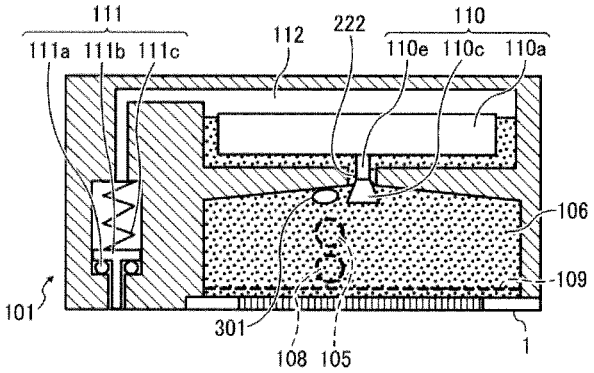
FIG. 18 is a schematic front view of the ink supply system in the fifth exemplary embodiment.

As a result, as illustrated in FIG. 18, when a bubble 301 enters the ink chamber 106, the bubble 301 rises to a topmost portion, i.e., the sealing portion 110*c* by flotation, passes the clearance, and moves into the exhaust passage 112.

In addition, when air accumulates in the exhaust passage 112 over time, as illustrated in FIG. 16, an ink level in the exhaust passage 112 decreases, thus lowering the float 110*a*. At this time, the sealing portion 110*c* is detached from the inlet portion 222 of the exhaust passage 112. In this state, when air exhaust is started, air is discharged from the exhaust passage 112 and the ink level in the exhaust passage 112 rises. As a result, as illustrated in FIG. 17, the sealing portion 110*c* contacts the inlet portion 222 of the exhaust passage 112.

At this time, since the sealing portion 110*c* does not fully seal the inlet portion 222 of the exhaust passage 112, ink flows from the ink chamber 106 to the exhaust passage 112. However, since pressure loss sharply increases, a negative pressure in the exhaust passage 112 increases. As a result, the exhaust pressure detector 40 can detect that air exhaust is completed.

In the fifth exemplary embodiment, since the float 110*a* is disposed in the exhaust passage 112, the sealing portion 110*c* is constantly soaked in ink.

Such a configuration can prevent a failure, such as fixing of the sealing portion 110*c* due to drying. As a result, even if the permeability of the film member 107 forming part of the head tank 101 is insufficient with respect to a long-term non-operation, the ink supply system in this exemplary embodiment can easily maintain a performance of the float valve 110.

As described above, an ink supply system according to any of the above-described exemplary embodiments can supply ink at a large flow amount by using a negative-pressure conjunction valve and a pressurizing pump, and can also discharge air from a head tank without discharging ink in a simple configuration of using a single pump for both ink suction and air exhaust.

Next, a sixth exemplary embodiment of the present disclosure is described with reference to FIG. 19.

Figure 19:
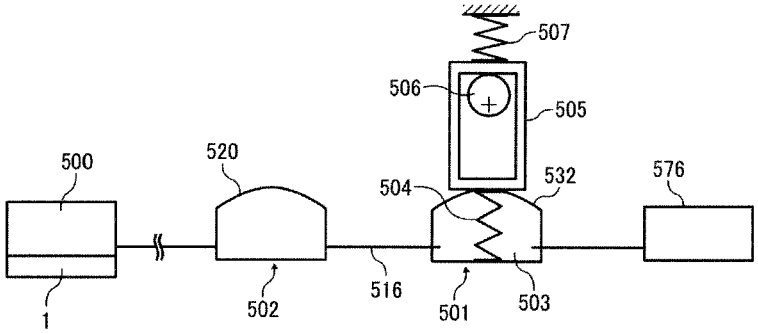
FIG. 19 is a schematic view of an ink supply system in a sixth exemplary embodiment of this disclosure.

FIG. 19 is a schematic view of an ink supply system in the sixth exemplary embodiment.

In the sixth exemplary embodiment, a supply pump 501 supplies ink from an ink cartridge 576 to a head tank 500 via a supply passage 516, and a pressure buffer chamber 502 is provided between the supply pump 501 and the head tank 500.

In this exemplary embodiment, the supply pump 501 is a diaphragm pump, and a wall face of a pump chamber 503 is partially formed of a deformable diaphragm 532. The pump chamber 503 includes a spring 504 to urge the diaphragm 532 outward.

A diaphragm pushing member 505 is disposed at an outer side of the pump chamber 503 to push the diaphragm 532, and the diaphragm pushing member 505 is urged toward the diaphragm 532 by a restoring force of a spring 507. By contrast, an eccentric cam 506 is disposed at a side of the diaphragm pushing member 505 opposite a side at which the spring 507 is disposed.

For the supply pump 501, when the pump chamber 503 inflates, ink is sucked from the ink cartridge 576. As a result, the pump chamber 503 contracts to supply ink to the head tank 500.

In other words, when the eccentric cam 506 is rotated, the diaphragm pushing member 505 is urged toward the pump chamber 503 by the restoring force of the spring 507 to push the diaphragm 532. As a result, the pump chamber 503 contracts to supply ink to the pressure buffer chamber 502.

In addition, when the eccentric cam 506 is rotated, the diaphragm pushing member 505 retracts in a direction away from the diaphragm 532 of the pump chamber 503. As a result, the diaphragm 532 is pushed outward by a restoring force of the spring 504 and the pump chamber 503 inflates, thus sucking ink from the ink cartridge 576 to the pump chamber 503.

For the supply pump 501, a pressure in the pump chamber 503 is generated by the restoring fortes of the springs 504 and 507. When the pump chamber 503 inflates, the pressure decreases due to the restoring force of the spring 504. By contrast, when the pump chamber 503 contracts, the pressure increases due to the restoring force of the spring 507.

Here, in a case in which driving of the eccentric cam 506 continues during printing, the pressure decreases due to both driving of the supply pump 501 and printing. As a result, the interior of the head tank 500 might turn into an excessive negative pressure and hamper maintaining of a normal print quality.

Hence, in this exemplary embodiment, the pressure buffer chamber 502 is provided to buffer pressure between the pump chamber 503 and the head tank 500.

The pressure buffer chamber 502 has a wall face partially formed of a deformable member, e.g., an elastic member 520, and has a variable capacity. When ink is supplied from the pump chamber 503 to the pressure buffer chamber 502, the pressure buffer chamber 502 is filled with ink and turns into a pressurized state. Ink is replenished to the head tank 500 by an amount of ink ejected from the recording head 1, and ink is supplied to the pump chamber 503 by an amount of ink reduced from the pressure buffer chamber 502.

For such a configuration, when the pressure in the pump chamber 503 increases or decreased due to inflation or contraction of the pump chamber 503, a pressure in the pressure buffer chamber 502 increases or decreases so as to buffer the increase or decrease of the pressure in the pump chamber 503. As a result, a pressure decrease of the pressure buffer chamber 502 is less than that of the pump chamber 503. Even if a pressure decrease is caused by printing, such a configuration prevents the head tank 500 from turning into an excessive negative pressure.

The pressure buffer chamber 502 can be disposed at any position between the pump chamber 503 and the head tank 500. For example, the pressure buffer chamber 502 may be included in the pump chamber 503 or the head tank 500.

An variable amount of the capacity of the pressure buffer chamber 502 is set to be not less than an amount obtained by multiplying a driving period to push the pump chamber 503 and a maximum ejection amount of ink from the recording head 1 per unit time. As the driving period is shorter, the capacity of the pressure buffer chamber 502 can be set to be smaller. By contrast, as the driving period is longer, the capacity of the pressure buffer chamber 502 can be set to be larger. As the driving period is shorter, a number of times at which the supply pump 501 serving as a diaphragm pump is pushed is greater, and the supply pump 501 preferably has higher durability.

Next, fluctuations in pressure in a pressurizing chamber of the head tank 500 with or without the pressure buffer chamber 502 is described with reference to FIG. 20.

Figure 20A:
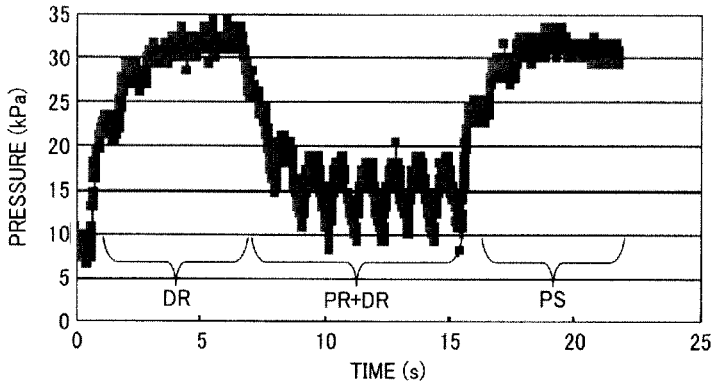
FIG. 20A is a chart of fluctuations of pressure in a comparative example in which the ink supply system of the sixth exemplary embodiment is not provided with a pressure buffer chamber.
Figure 20B:
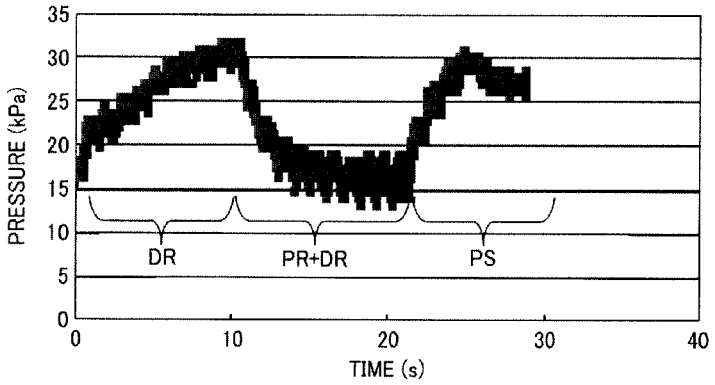
FIG. 20B is a chart of fluctuations of pressure in the ink supply system of the sixth exemplary embodiment provided with a pressure buffer chamber.

FIG. 20A is a chart of an example of fluctuations in pressure in a pressurizing chamber of the head tank 500 without the pressure buffer chamber 502. FIG. 20B is a chart of an example of fluctuations in pressure in the pressurizing chamber of the head tank 500 with the pressure buffer chamber 502. For these examples, first, when the supply pump 501 is driven (DR), pressure in the pressurizing chamber of the head tank 500 increases. When the supply pump 501 is continuously driven, the recording head 1 ejects ink droplets to perform printing (PR+DR). Then, printing is stopped and only the driving of the supply pump 501 is continued (PS). FIGS. 20A and 20B are measurement results of fluctuations in the pressure in the pressurizing chamber 102 in the above-described operations.

In a case in which the pressure buffer chamber 502 is not provided, as illustrated in FIG. 20A, pressure decreases in the pressurizing chamber during printing (PR+DR) are relatively large, and a fluctuation range of increases and decreases in the pressure is relatively large. By contrast, in a case in which the pressure buffer chamber 502 is provided, as illustrated in FIG. 20B, pressure decreases in the pressurizing chamber during printing (PR+DR) are relatively small, and a fluctuation range of increases and decreases in the pressure is relatively small, as compared to the case in which the pressure buffer chamber 502 is not provided.

Next, the head tank 500 in this exemplary embodiment is described with reference to FIG. 21.

Figure 21:
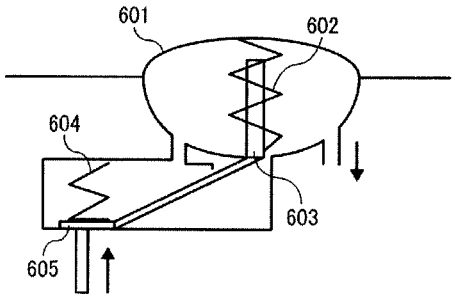
FIG. 21 is a schematic view of a negative pressure interlock assembly of a head tank in the sixth exemplary embodiment.

FIG. 21 is a schematic view of a negative pressure interlock assembly of the head tank 500.

The head tank 500 includes an elastic member 601, a spring 602, a member 603, a spring 604, and a valve 605. The elastic member 601 is deformable in response to negative pressure created by the spring 602. When a negative pressure in the head tank 500 is not greater than a threshold value, the elastic member 601 contacts the member 603 and the valve 605 urged by the spring 604 is opened. When the valve 605 is opened, ink is introduced from the pressurizing chamber maintained in a normal pressure range. As the pressure in the head tank 500 increases, the elastic member 601 detaches from the member 603 and the valve 605 is closed.

When ink is ejected from the recording head 1 and the negative pressure in the head tank 500 rises, the valve 605 is opened to replenish ink from a supply side. By repeating an operation in which the negative pressure in the head tank 500 decreases and the valve 605 is closed, ink supply to the head tank 500 is controlled.

Next, a seventh exemplary embodiment of the present disclosure is described with reference to FIG. 22.

Figure 22:
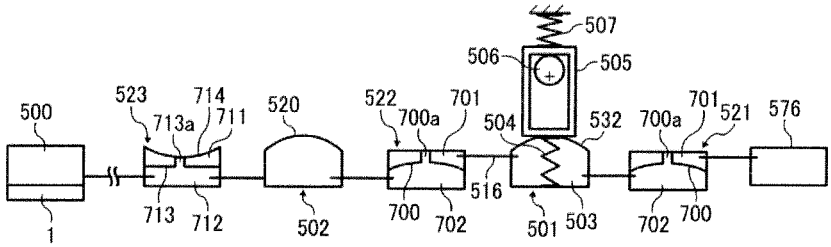
FIG. 22 is a schematic view of an ink supply system in a seventh exemplary embodiment of this disclosure.

FIG. 22 is a schematic view of an ink supply system in the seventh exemplary embodiment.

In the seventh exemplary embodiment, a valve 521 is disposed between an ink cartridge 576 and a pump chamber 503 of a supply pump 501. A valve 522 is disposed between the supply pump 501 and a pressure buffer chamber 502. A valve 523 is disposed between the pressure buffer chamber 502 and a head tank 500.

Each of the valve 521 and the valve 522 includes a first chamber 701 and a second chamber 702 partitioned by a valve member 700. For example, when ink flows into the first chamber 701, the valve member 700 moves downward, thus opening an opening 700*a* of the valve member 700. As a result, the first chamber 701 and the second chamber 702 are communicated with each other, thus turning into an open state.

The valve 523 has a first chamber 711 and a second chamber 712 partitioned by a wall portion 713. A deformable valve member 714 forms a wall face of the first chamber 711 and opens and closes an opening 713*a* of the wall portion 713. For example, when ink flows into the first chamber 711, the valve member 714 detaches from the opening 713*a*. As a result, the first chamber 711 and the second chamber 712 are communicated with each other, thus turning into an open state.

Here, when the pump chamber 503 contracts, the valve 521 between the pump chamber 503 and the ink cartridge 576 is closed, thus shutting off ink feeding from the pump chamber 503 to the ink cartridge 576. When the valve 522 between the pump chamber 503 and the pressure buffer chamber 502 is opened, ink is fed from the pump chamber 503 to the pressure buffer chamber 502.

When the pump chamber 503 inflates, the valve 522 between the pump chamber 503 and the pressure buffer chamber 502 is closed, thus shutting off ink feeding from the pressure buffer chamber 502 to the pump chamber 503. When the valve 521 between the pump chamber 503 and the ink cartridge 576 is opened, ink is fed from the ink cartridge 576 to the pump chamber 503.

Next, an eighth exemplary embodiment of this disclosure is described with reference to FIG. 23.

Figure 23:
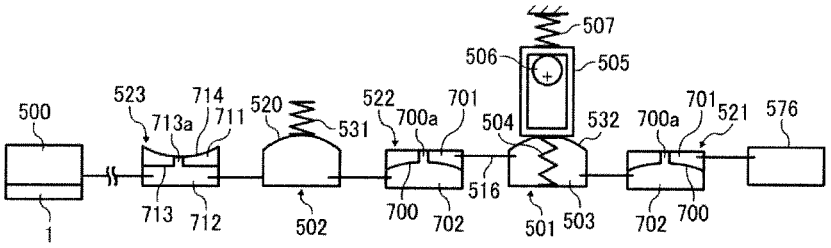
FIG. 23 is a schematic view of an ink supply system in an eighth exemplary embodiment of this disclosure.

FIG. 23 is a schematic view of an ink supply system in the eighth exemplary embodiment.

The ink supply system of the eighth exemplary embodiment differs from the ink supply system of the above-described seventh exemplary embodiment in that a spring 531 provided at an outer side (a side at which ink does not pass) of a deformable elastic member 520 forming a wall face of a pressure buffer chamber 502 to minimize a range of fluctuations of pressure in the pressure buffer chamber 502.

It is to be noted that, instead of the spring 531, pressurizing air may be blown to the outer side of the elastic member 520 to press the elastic member 520, thus allowing pressure control.

Next, a ninth exemplary embodiment of the present disclosure is described with reference to FIG. 24.

Figure 24:
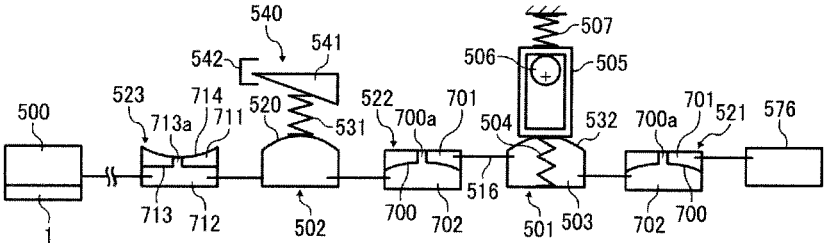
FIG. 24 is a schematic view of an ink supply system in a ninth exemplary embodiment of this disclosure.

FIG. 24 is a schematic view of an ink supply system in the ninth exemplary embodiment.

The ink supply system of the ninth exemplary embodiment differs from the ink supply system of the eighth exemplary embodiment in that a remaining amount detector 540 is disposed at an outer side of a pressure buffer chamber 502.

A lever member 541 and a detection member 542 are provided at an outer side (a side at which ink does not pass) of the pressure buffer chamber 502. The lever member 541 is displaceable with displacement of an elastic member 520 of the pressure buffer chamber 502. The detection member 542 detects whether or not the lever member 541 is placed within a certain displacement area.

Here, when the ink cartridge 576 runs out of ink, ink is lost in the pressure buffer chamber 502. As a result, pressure in the pressure buffer chamber 502 decreases, thus contracting the pressure buffer chamber 502. To maintain such a state, the lever member 541 moves away from a detection area of the detection member 542. As a result, the detection member 542 cannot detect the lever member 541. When the lever member 541 is not detected for a threshold time, a controller determines that no ink remains in the ink cartridge 576. The threshold time is counted by a timer. When a count time of the timer is the threshold time or greater, the controller determines that the ink cartridge 576 is out of ink.

Alternatively, an ink end state may be detected by detecting a displacement of the diaphragm 532 of the pump chamber 503 of the supply pump 501 with the lever member 541 and the detection member 542.

Next, a tenth exemplary embodiment of the present disclosure is described with reference to FIG. 25.

Figure 25:
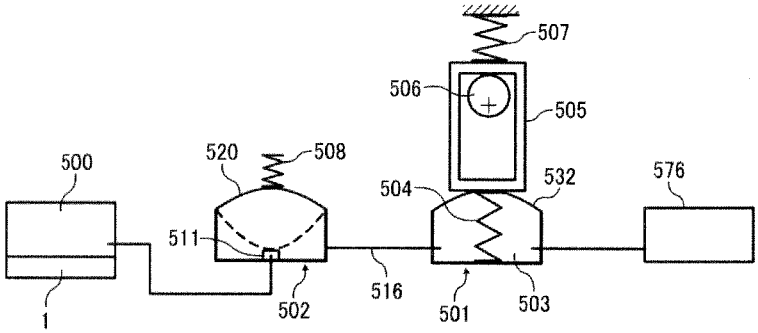
FIG. 25 is a schematic view of an ink supply system in a tenth exemplary embodiment of this disclosure.

FIG. 25 is a schematic view of an ink supply system in the tenth exemplary embodiment.

The ink supply system in the tenth exemplary embodiment differs from the ink supply system in the above-described sixth exemplary embodiment in that, a spring 508 is provided as an elastic member of a pressurizing unit to urge a deformable elastic member 520 from an exterior to an interior of the elastic member 520. A liquid outlet 511 communicated with the head tank 500 is disposed at a position closed by the elastic member 520 when the elastic member 520 deforms inward, e.g., at a lower surface of a pressure buffer chamber 502 in FIG. 25.

For such a configuration, when the pressure buffer chamber 502 sucks ink from a recording head I, the elastic member 520 deforms to a position indicated by a broken line in FIG. 25, thus closing the liquid outlet 511.

As a result, a negative pressure increases at a downstream side from the liquid outlet 511 closed. When the supply pump 501 pressurizes ink from an upstream side with respect to the liquid outlet 511, an ink flow sharply speeds up, thus effectively discharging bubbles.

Next, an eleventh exemplary embodiment of the present disclosure is described with reference to FIG. 26.

Figure 26:
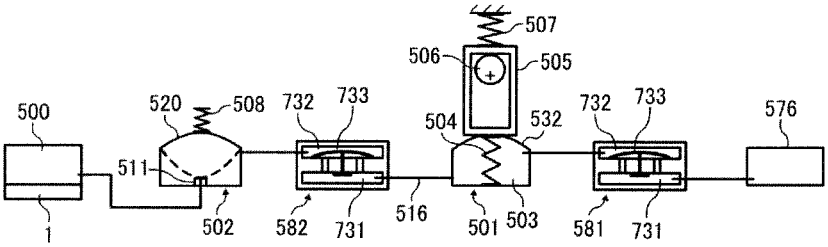
FIG. 26 is a schematic view of an ink supply system in an eleventh exemplary embodiment of this disclosure.

FIG. 26 is a schematic view of an ink supply system in the eleventh exemplary embodiment.

The ink supply system in the eleventh exemplary embodiment differs from the ink supply system in the above-described tenth exemplary embodiment in that a valve 581 is disposed between the ink cartridge 576 and the supply pump 501 to allow liquid to be fed in only one direction and a valve 582 is disposed between the supply pump 501 and the pressure buffer chamber 502 to allow liquid to be fed in only one direction.

Each of the valve 581 and the valve 582 has a valve member 733. When ink flows from an upstream channel 731 to a downstream channel 732, the valve member 733 opens. By contrast, when ink flows from the downstream channel 732 to the upstream channel 731, the valve member 733 closes.

For such a configuration, when the pump chamber 503 of the supply pump 501 contracts, the valve 581 between the pump chamber 503 and the ink cartridge 576 closes to block ink feeding from the pump chamber 503 to the ink cartridge 576.

Meanwhile, the valve 582 between the pump chamber 503 and the pressure buffer chamber 502 opens to feed ink from the pump chamber 503 to the pressure buffer chamber 502.

By contrast, when the pump chamber 503 of the supply pump 501 inflates, the valve 582 closes to block ink feeding from the pressure buffer chamber 502 to the pump chamber 503.

Meanwhile, the valve 581 pens to feed ink from the ink cartridge 576 to the pump chamber 503.

Such a configuration can stably feed ink from the ink cartridge 576 to the head tank 500 while using a diaphragm pump as the supply pump 501.

Next, a twelfth exemplary embodiment of this disclosure is described with reference to FIG. 27.

Figure 27:
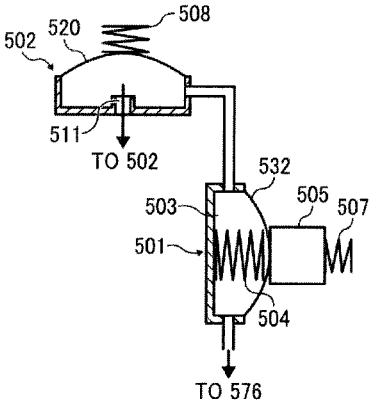

FIG. 27 is a schematic view of a portion of an ink supply system in the twelfth exemplary embodiment.

The ink supply system in the twelfth exemplary embodiment differs from the ink supply system in the tenth exemplary embodiment in that a pressure buffer chamber 502 is horizontally disposed so that ink flows from a liquid outlet 511 in a vertically downward direction. In addition, a supply pump 501 is vertically disposed so that ink is fed from a lower side to an upper side in a vertical direction.

For such a configuration, if bubbles flows from the pump chamber 503 of the supply pump 501 into the pressure buffer chamber 502, the bubbles gather toward an elastic member 520 by flotation, thus facilitating the bubbles to be discharged from the liquid outlet 511 by deformation of the elastic member 520. The supply pump 501 has an inlet of ink to the pump chamber 503 at a lower side and an outlet of ink from the pump chamber 503 at an upper side, thus facilitating bubble discharge.

Next, a thirteenth exemplary embodiment of this disclosure is described with reference to FIG. 28.

FIG. 28 is a schematic view of a portion of an ink supply system in the thirteenth exemplary embodiment.

For the thirteenth exemplary embodiment, like the ninth exemplary embodiment, a remaining amount detector 550 is disposed at an outer side of a pressure buffer chamber 502.

At the outer side (at which ink does not flow) of the pressure buffer chamber 502 are disposed a lever member 551 displaceable with displacement of an elastic member 520 and a detection member 552 to detect whether or not the lever member 551 is within a certain displacement area. The lever member 551 is urged toward the elastic member 520 by a spring 553 disposed between a fixed portion and the lever member 551.

The thirteenth exemplary embodiment obtains operation effects equivalent to those of the ninth exemplary embodiment.

Any one of the above-described first to fifth exemplary embodiments may be combined with any one of the above-described sixth to thirteenth exemplary embodiments.

Next, a fourteenth exemplary embodiment of this disclosure is described with reference to FIG. 29.

FIG. 29 is a schematic view of a portion of a maintenance device in the fourteenth exemplary embodiment.

In this exemplary embodiment, a head tank 101 includes ink chambers for four colors of cyan (C), black (K), magenta (M), and yellow (Y) and float valves 110C, 110K, 110M, and 110Y for the four colors.

In this exemplary embodiment, an exhaust passage 112 is a common passage for the four colors, and an air release valve 111 is disposed in a frame 18 of a recording head 1. At this time, a bottom face of the head tank 101 serves as a receiving face to receive a compression spring 110*c* of the air release valve 111.

A suction cap 36 of a maintenance device 31 has an opening portion in which a plurality of spaces 36*a* and 36*b* is divided. In sucking the recording head 1, such a configuration allows nozzles of the recording head 1 to be sucked in a selective manner as well as in a collective manner, thus allowing recovery from a non-ejection state of the recording head 1 by a minimum consumption amount of ink.

The spaces 36*a* and 36*b* and an exhaust cap 37 are connected to (communicated with) a suction pump 34 via a passage switching member 35.

Here, an example of the passage switching member 35 is described with reference to FIGS. 30 and 31.

FIG. 30 is an exploded perspective view of the passage switching member 35 in this exemplary embodiment. FIGS. 32A to 32D are plan views of the passage switching member 35 during switching operation.

The passage switching member 35 includes a passage housing 35*a*, a passage switching valve 35*b*, and a base 35*c*.

The passage housing 35*a* is a passage member including a connection port 361*a* connected to the space 36*a* of the suction cap 36, a connection port 361*b* connected to the space 36*b*, a connection port 371 connected to the exhaust cap 37, and a connection port 341 connected to the suction pump 34.

The passage switching valve 35*b* is a cylindrical rubber member having a plurality of grooves 351*a* to 351*d* forming liquid passages. The passage switching valve 35*b* is fixed on the base 35*c*. When the base 35*c* receives driving of a motor, the passage switching valve 35*b* rotates to switch opening and closing of a passage connected to the passage housing 35*a*.

Figure 31A:
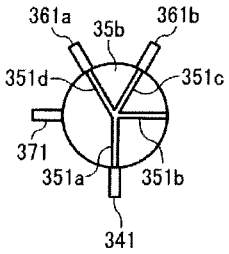
Figure 31B:
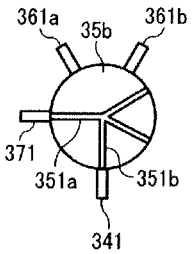

In a normal state of the passage switching member 35, as illustrated in FIG. 31A, the passage switching member 35*b* is rotated to a position at which the groove 351*a* is communicated with the connection port 341 connected to the suction pump 34, the groove 351*c* is communicated with the connection port 361*b* connected to the space 36*b* of the suction cap 36, the groove 351*d* is communicated with the connection port 361*a* connected to the space 36*a* of the suction cap 36, and none of the grooves 351*a* to 351*d* are communicated with the exhaust cap 37.

Thus, the suction pump 34 is connected to the spaces 36*a* and 36*b* of the suction cap 36 and is not connected to the exhaust cap 37.

Hence, when sucking operation is performed on all nozzles of the recording head 1, in the normal state, the suction pump 34 is driven for a certain time.

In initial ink filling or air exhaust, as illustrated in FIG. 31 B, the passage switching valve 35*b* is rotated to connect the suction pump 34 and the exhaust cap 37, and the suction pump 34 is driven for a certain time.

Figure 31C:
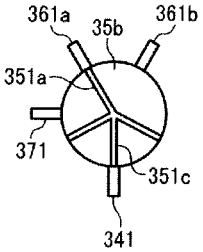
Figure 31D:
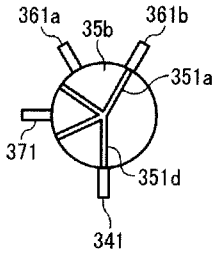

When sucking operation is performed on particular nozzles, as illustrated in FIGS. 31C and 31D, the spaces 36*a* and 36*b* of the suction cap 36 are connected to the suction pump 34 and the suction pump 34 is driven for a certain time.

Next, a fifteenth exemplary embodiment of this disclosure is described with reference to FIGS. 32A to 32D.

FIGS. 32A to 32D are schematic views of a passage switching member 35 of a maintenance device in the fifteenth exemplary embodiment.

The passage switching member 35 has a common sucking passage member 35*g* communicated with a suction pump 34, a plurality of sucking passages 35*d* made of a flexible tube connected to spaces 36*a* and 36*b* of a suction cap 36 and an exhaust cap 37, and a roller 35*e* having a plurality of ribs 35*f* on an outer circumferential face to simultaneously or selectively compress the sucking passages 35*d*.

When the roller 35*e* rotates, as illustrated in FIGS. 32A to 32D, the sucking passages 35*d* are simultaneously or selectively opened and closed, thus allowing sucking of the spaces 36*a* and 36*b* of the suction cap 36 and the exhaust cap 37 with a single suction pump, i.e., the suction pump 34.

Figure 32A:
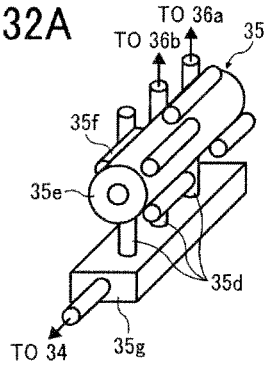
Figure 32B:
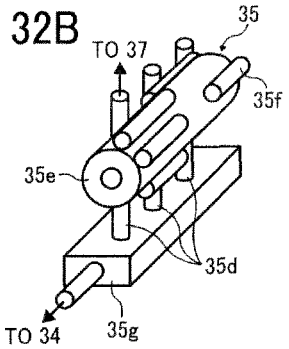
Figure 32C:
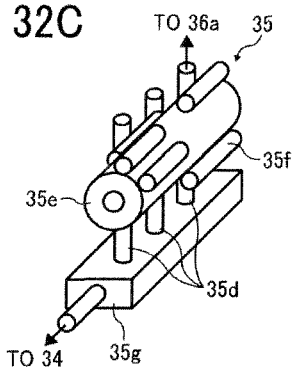
Figure 32D:
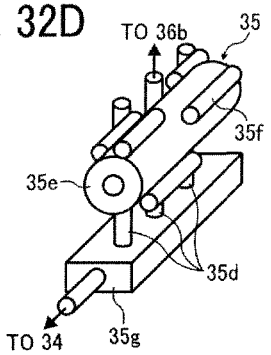

FIG. 32A shows a state in which the suction pump 34 is connected to the spaces 36*a* and 36*b* of the suction cap 36. FIG. 32B shows a state in which the suction pump 34 is connected to the exhaust cap 37. FIG. 32C shows a state in which the suction pump 34 is connected to the space 36*a* of the suction cap 36. FIG. 36D shows a state in which the suction pump 34 is connected to the space 36*b* of the suction cap 36.

In the above-described fourteenth and fifteenth exemplary embodiments, the number of the plurality of space of the suction cap 36 are two. However, it is to be noted that the configuration of the suction cap 36 is not limited to the above-described configuration. For example, as described in, e.g., the first exemplary embodiment, one suction cap may correspond to one recording head, or one suction cap may include three or more spaces. Alternatively, in the fourteenth exemplary embodiment, the passage switching valve 35*b* may have a plurality of passages corresponding to the plurality of spaces of the suction cap 36, thus allowing sucking operation on particular nozzles with a single suction pump. In the fifteenth exemplary embodiment, the roller 35*e* may have a plurality of ribs corresponding to the plurality of spaces of the suction cap 36, thus allowing sucking operation on particular nozzles with a single suction pump.

Next, a sixteenth exemplary embodiment of this disclosure is described with reference to FIGS. 33 and 34.

FIG. 33 is a schematic view of a maintenance device in the sixteenth exemplary embodiment. FIG. 34 is a schematic view of an ink supply system and an exhaust system in the sixteenth exemplary embodiment.

In this exemplary embodiment, a recording head 1 and a head tank 101 each has a configuration similar to, even if not the same as, the configuration of the above-described fourteenth exemplary embodiment (see FIG. 29). The ink supply system in this sixteenth exemplary embodiment has a configuration similar to, even if not the same as, the configuration of the above-described ninth exemplary embodiment (see FIG. 24). Therefore, descriptions thereof are omitted below.

In this sixteenth exemplary embodiment, suction of a suction cap 36 and suction of an exhaust cap 37 are performed by different lines. The suction cap 36 is connected to a suction pump 34, and the exhaust cap 37 is connected to a suction pump 901 (P3 in FIG. 33).

The suction pump 901 has a configuration similar to, even if not the same as, the configuration of the supply pump 501 described in the sixth exemplary embodiment (see FIG. 19). Like the above-described seventh exemplary embodiment (see FIG. 22), valves 521 and 522 are disposed upstream and downstream from the suction pump 901.

Eccentric cams 506 of the suction pump 901 and the supply pump 501 are rotated by a single driving source 902. In such a case, for example, a clutch may be provided on a drive transmission route so as not to simultaneously drive the suction pump 901 and the supply pump 501, Waste ink discharged by the suction pump 901 is stored in a waste liquid tank 900.

As described above, the sixteenth exemplary embodiment provides a simple configuration. In addition, a diaphragm pump forming the suction pump 901 is a constant pressure pump to generate pressure by a restoring force of a spring, thus preventing an excessive negative pressure of the exhaust cap 37 without detecting an exhaust pressure as described above.

Next, a seventeenth exemplary embodiment of this disclosure is described with reference to FIG. 35.

FIG. 35 is a schematic view of a maintenance device in the seventeenth exemplary embodiment.

In this seventeenth exemplary embodiment, a suction cap 36 and a moisture retention cap 32 are separately provided. Such a configuration can reduce the size of the suction cap 36 and perform sucking operation on particular nozzles, thus minimizing waste ink consumed by sucking nozzles.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a liquid ejection head having nozzles to eject droplets of liquid and a nozzle face in which the nozzles are formed;

a head tank to supply the liquid to the liquid ejection head, the head tank comprising an elastic member at a top wall face of the head tank;

a liquid storage container to store the liquid;

a liquid feed device comprising a pressurizing pump to pressure and supply the liquid from the liquid storage container to the head tank;

a supply valve disposed in the head tank adjacent to the elastic member to open when a negative pressure in the head tank is greater than a predetermined value;

an exhaust passage disposed in the head tank and communicated with an ambient air;

a float valve disposed in the head tank to close the exhaust passage in response to an amount of the liquid in the head tank;

an air release valve to open and close the exhaust passage of the head tank; and a suction device to exhaust air from the exhaust passage, wherein, when the suction device exhausts air from the exhaust passage with the air release valve open, the pressurizing pump of the liquid feed device is driven to pressurize and feed the liquid, wherein as the liquid in the head tank is consumed the elastic member is displaced toward an interior of the head tank to drive the supply valve from a closed state to an open state, and the supply valve in the open state permits communication between the head tank and the liquid storage container, wherein the exhaust passage comprises a groove having an arc-shaped cross section in a short direction of the groove, and formed along the top wall face of the head tank, wherein the elastic member has a thin film shape to cover at least a portion of the groove, and the elastic member an outer surface portion contacting an exterior of the head tank, and an inner surface portion opposing the groove, and wherein when the float valve closes the exhaust passage, the elastic member deforms to compress and choke the exhaust passage.

2. The image forming apparatus of claim 1, wherein the elastic member comprises a first face and a second face opposite the first face, and the first face faces the exhaust passage and the second face faces a layer of the liquid.

3. An image forming apparatus comprising:

a liquid ejection head having nozzles to eject droplets of liquid and a nozzle face in which the nozzles are formed;

a head tank to supply the liquid to the liquid ejection head;

a liquid storage container to store the liquid;

a liquid feed device to feed the liquid from the liquid storage container to the head tank;

a supply valve disposed in the head tank to open when a negative pressure in the head tank is greater than a predetermined value;

an exhaust passage disposed in the head tank an communicated with an ambient air;

a float valve disposed in the head tank to close the exhaust passage in response to an amount of the liquid in the head tank;

an air release valve to open and close the exhaust passage of the head tank;

a suction device to exhaust air from the exhaust passage; and an exhaust pressure detector to detect an exhaust pressure when the suction device is connected to the air release valve and sucks and exhausts air, wherein, when the suction device exhausts air from the exhaust passage with the air release valve open, the liquid feed device is driven to pressurize and feed the liquid, and wherein the exhaust pressure detector is disposed between the suction device and the air release valve.

4. The image forming apparatus of claim 1, wherein the suction device sucks the liquid from the nozzles of the liquid ejection head.

5. The image forming apparatus of claim 4, further comprising:

a suction cap to cap the nozzle face of the liquid ejection head;

an exhaust cap to cap a face of the liquid ejection head having an opening, the opening communicated with the exhaust passage and disposed downstream from the air release valve; and a passage switching member to switch passages to suck the liquid and exhaust air, wherein the suction cap has a plurality of internal spaces, and the plurality of internal spaces and the exhaust cap are connected to the suction device via the passage switching member.

6. The image forming apparatus of claim 1, wherein the float valve has a porous body at a portion to contact the exhaust passage, and the porous body at least partially contacts the liquid.

7. The image forming apparatus of claim 1, wherein the float valve has a float portion in the exhaust passage.

8. The image forming apparatus of claim 1, further comprising a pressure buffer having an elastically deformable wall face to temporarily store the liquid, wherein the liquid feed device has a pressurizing pump and the head tank.

9. The image forming apparatus of claim 8, further comprising a pressurizing member to urge the elastically deformable wall face of the pressure buffer inward, wherein the pressure buffer has a liquid outlet connected to the head tank, and the liquid outlet is disposed at a position closed by the elastically deformable wall face when the elastically deformable wall face deforms inward.

10. An image forming apparatus comprising:

a liquid ejection head having nozzles to eject droplets of liquid and a nozzle face in which the nozzles are formed;

a head tank to supply the liquid to the liquid ejection head, the head tank comprising a film member at a wall face of the head tank;

a liquid storage container to store the liquid;

a liquid feed device comprising a pressurizing pump to pressurize and supply the liquid from the liquid storage container to the head tank;

a supply valve disposed in the head tank adjacent to the film member to open when a negative pressure in the head tank is greater than a predetermined value;

an exhaust passage disposed in the head tank and communicated with an ambient air;

a float valve disposed in the head tank to close the exhaust passage in response to an amount of the liquid in the head tank;

an air release valve to open and close the exhaust passage of the head tank, a suction device to exhaust air from the exhaust passage;

a pressure buffer having an elastically deformable wall face to temporarily store the liquid, wherein the pressure buffer is disposed between the pressurizing pump and the head tank; and a valve unit to allow ink to he fed in only one direction, wherein the valve unit is disposed between the liquid storage container and the pressurizing pump and between the pressurizing pump and the pressure buffer, wherein, when the suction device exhausts air from the exhaust passage with the air release valve open the pressurizing pump of the liquid feed device is driven to pressurize and feed the liquid, and wherein as the liquid in the head tank is consumed the film member is displaced toward an interior of the head tank to drive the supply valve from a closed state o an open state, and the supply valve in the open state permits communication between the head tank and the liquid storage container.

11. The image forming apparatus of claim 1, further comprising a common driving source to drive the liquid feed device and the suction device.

12. The image forming apparatus of claim 10, further comprising a pressurizing member to urge the elastically deformable wall face of the pressure buffer inward, wherein the pressure buffer has a liquid outlet connected to the head tank, and the liquid outlet is disposed at a position closed by the elastically deformable wall face when the elastically deformable wall face deforms inward.

* * * * *